US005923261A

United States Patent [19]

Castonguay et al.

[11] Patent Number: 5,923,261

[45] Date of Patent: Jul. 13, 1999

[54] CIRCUIT BREAKER BELL ALARM ACCESSORY WITH AUTOMATIC RESET

[75] Inventors: Roger N. Castonguay, Terryville; Dean A. Robarge, Southington, both of Conn.

[73] Assignee: General Electric Company, Schenectady, N.Y.

[21] Appl. No.: 08/904,324

[22] Filed: Jul. 31, 1997

[51] Int. Cl.[6] ..... G08B 21/00

[52] U.S. Cl. ..... 340/638; 335/17; 361/115; 200/400; 200/401

[58] Field of Search ..... 340/638, 687; 335/17, 14; 361/115; 324/424; 200/400, 401

[56] References Cited

U.S. PATENT DOCUMENTS

| | | | |
|---|---|---|---|
| 3,084,238 | 4/1963 | Baskerville | 200/153 |
| 3,095,489 | 6/1963 | Baird | 200/153 |
| 4,167,988 | 9/1979 | Acampora et al. | 185/40 R |
| 4,211,989 | 7/1980 | Acampora | 335/17 |
| 4,246,558 | 1/1981 | Zubaty et al. | 335/20 |
| 4,672,501 | 6/1987 | Bilac et al. | 361/96 |
| 5,153,544 | 10/1992 | Castonguay et al. | 335/167 |
| 5,502,286 | 3/1996 | Pollman et al. | 200/401 |
| 5,655,648 | 8/1997 | Rosen et al. | 200/401 |
| 5,673,786 | 10/1997 | Seymour et al. | 200/308 |
| 5,714,940 | 2/1998 | Fishovitz et al. | 340/638 |

OTHER PUBLICATIONS

U.S. application Ser. No. 08/863,649, R. N. Castonguay,et al., "Ratcheting Mechanism for Industrial Rated Circuit Breaker", filed May 27, 1995.

U.S. application GE Docket #41PR–7417, R. N. Castonguay, "Contact Position Indicator for an Industrial–Rated Circuit Breaker",filed Jun. 19, 1997.

U.S. application GE Docket #41PR–7418, R.N. Castonguay & D.A. Robarge, "Circuit Breaker Bell Alarm Accessory With Lockout", filed Jun. 19, 1997.

*Primary Examiner*—Daniel J. Wu
*Assistant Examiner*—Sihong Huang
*Attorney, Agent, or Firm*—Cantor Colburn LLP; Carl B. Horton

[57] ABSTRACT

An air circuit breaker bell alarm accessory interacts with the circuit breaker contact position indicator to provide local and remote indication of the occurrence of a circuit interruption. A drive pin extending from the bottom of the accessory interacts with a slot on the contact position indicator lever to reset the bell alarm accessory when the circuit breaker contacts are in the process of being closed.

16 Claims, 5 Drawing Sheets

CIRCUIT BREAKER BELL ALARM ACCESSORY WITH AUTOMATIC RESET

BACKGROUND OF THE INVENTION

Air circuit breakers as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

U.S. Pat. No. 08/878,598 entitled "Contact Position Indicator for an Industrial-Rated Circuit Breaker" describes the use of a target device to indicate the condition of the circuit breaker contacts as well as an interlock arrangement for preventing false indication thereof.

Various accessory devices are used with such air circuit breakers to provide auxiliary function along with overcurrent protection. One such accessory is the bell alarm accessory that provides local and remote indication as to the occurrence of circuit interruption. U.S. Pat. No. 5,502,286 entitled "Bell Alarm and Lock-Out for High Ampere-Rated Circuit Breakers" describes a bell alarm accessory used with so-called "insulated case" circuit breakers wherein the circuit breaker interrupting components are completely enclosed within an insulating plastic enclosure. This patent describes one such bell alarm accessory that interacts with the circuit breaker operating mechanism to activate the bell alarm upon circuit interruption and to prevent the closing of the circuit breaker contacts until the accessory is manually reset.

U.S. Pat. No. 08/878,595 entitled "Circuit Breaker Bell Alarm Accessory with Lockout" provides a bell alarm accessory that provides local as well as remote indication of such circuit interruption as well as preventing circuit breaker contact closure until and unless the accessory has become manually reset.

In most circuit breakers employing a bell alarm for status indication of the circuit breaker contacts, it is a requirement that the circuit breaker operating mechanism be reset before the bell alarm can be manually reset to indicate the circuit breaker closed condition. It would be more convenient, in certain applications, to allow the bell alarm accessory to become automatically reset immediately upon closure of the circuit breaker contacts without the requirement of manual intervention.

One purpose of the invention is to describe a bell alarm accessory that is automatically reset upon response of the circuit breaker operating mechanism to close the circuit breaker contacts.

SUMMARY OF THE INVENTION

An air circuit breaker bell alarm accessory interacts with the contact position indicator to provide local and remote indication of the occurrence of a circuit interruption. The signal flag in the form of a pin arranged at the top part of the accessory projects through an opening in the circuit breaker cover to provide visual indication as to the occurrence of a circuit interruption. A drive pin extending from the bottom of the bell alarm accessory interacts with a plunger on the bottom of the contact position indicator lever and a lever on the side thereof to automatically reset the bell alarm in the early stages of the closing of the circuit breaker contacts.

DESCRIPTION OF THE PREFERRED EMBODIMENT

Figure 1:
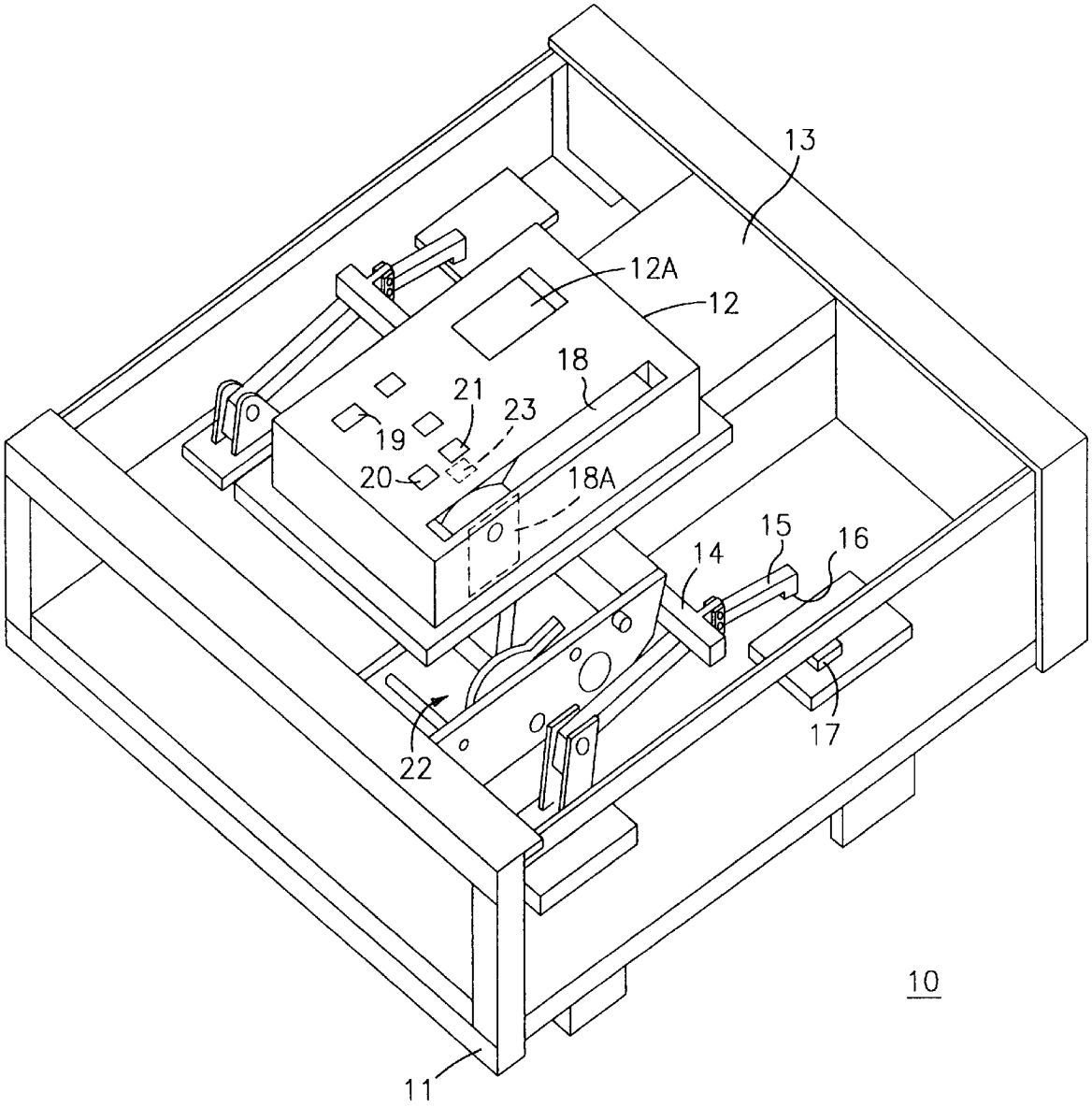
FIG. 1 is top perspective view of an air circuit breaker containing the bell alarm unit in accordance with the invention.

The air circuit breaker 10 of FIG. 1 is similar to that described within the aforementioned U.S. Pat. No. 3,095,489 and includes a metal frame 11 which supports the trip unit programmer 12A and the operating mechanism enclosure 13. The trip unit programmer is similar to that described in U.S. Pat. No. 4,672,501 entitled "Circuit Breaker and Protective Relay Unit". The circuit breaker cover 12 includes a trip button 19 for releasing the circuit breaker operating mechanism contained within the enclosure 13 for separating the circuit breaker contacts 16, 17 to their open condition and a closing button 21 for moving the contacts to their closed position. The circuit breaker contact arms 15 within each pole of a three pole circuit arrangement, are interconnected by means of the operating mechanism crossbar 14 to insure that all contacts within the separate poles both open and close in unison. The ratchet mechanism 22 improves over the earlier mechanism described in U.S. Pat. No. 4,167,988 entitled "Ratcheting Mechanism for Circuit Breaker Motor Operator" by allowing the operating mechanism closing spring described therein to be charged remotely by means of a motor operator as well as by means of the circuit breaker operating handle 18 that interacts with the ratchet mechanism 22 by means of a pair of plate connectors, one of which is indicated at 18A. The condition of the circuit breaker contacts is visually ascertained by means of the circuit breaker target plate 52 (FIG. 2) which is visible through apertures 53 formed in the circuit breaker cover 12. The occurrence of contact separation caused by an overcurrent condition within a protected circuit to which the circuit breaker is connected is depicted by transfer of the pop-up target 33 through the indicator aperture 37 formed in the circuit breaker cover 12 as best seen by now referring to the circuit breaker 10 as depicted in FIG. 2.

Figure 2:
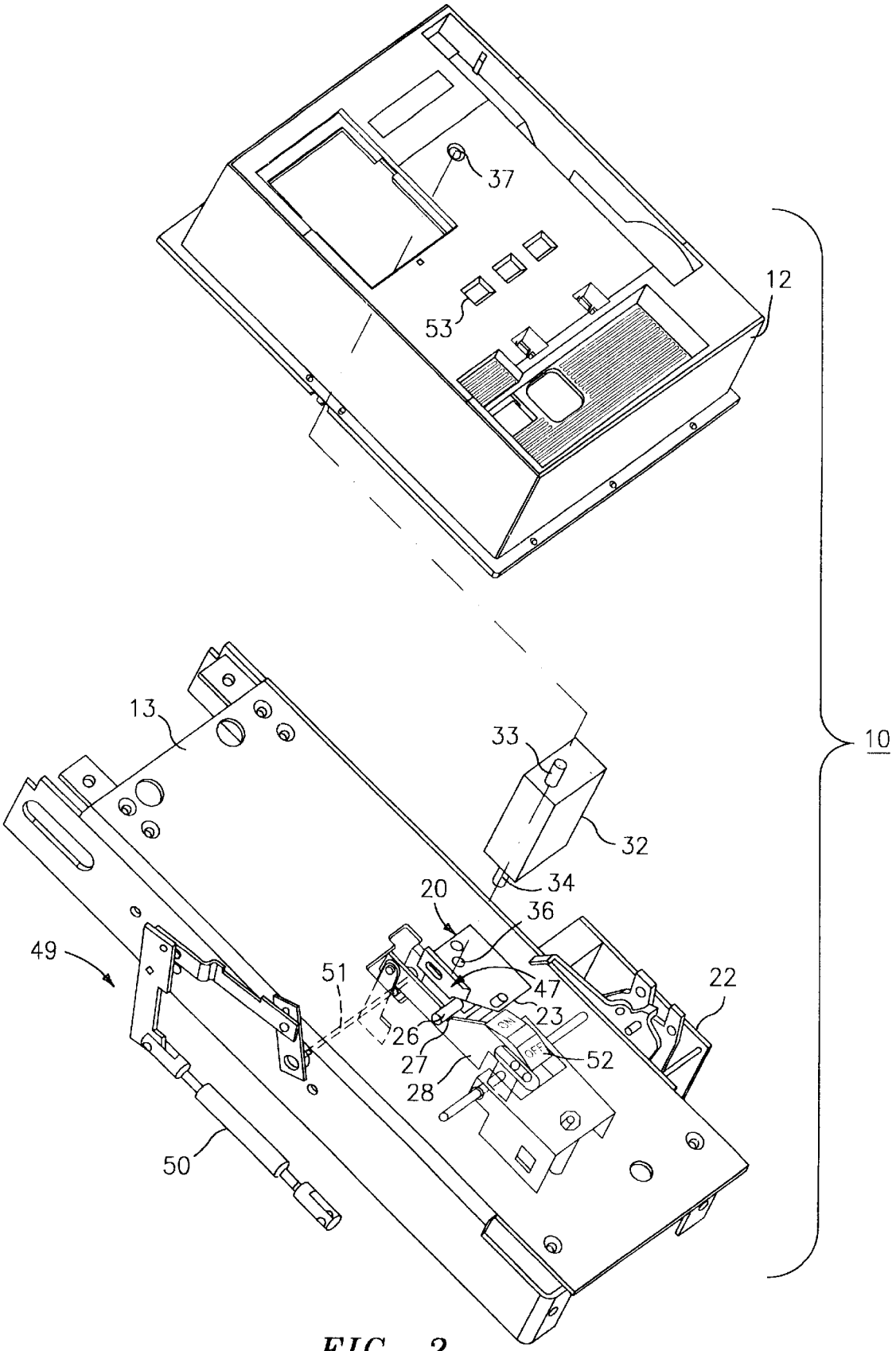
FIG. 2 is a top perspective view of the circuit breaker of FIG. 1 with the circuit breaker cover removed to detail the bell alarm unit in isometric relation with the circuit breaker operating mechanism enclosure.

The circuit breaker 10 of FIG. 1 is depicted in FIG. 2 with the circuit breaker cover 12 removed from the circuit breaker operating mechanism enclosure 13 to illustrate the position of the bell alarm unit 20 as arranged on the surface thereof intermediate the ratchet mechanism 22, which is described in U.S. patent application Ser. No. 08/863,649 entitled "Ratcheting Mechanism for Industrial-Rated Circuit Breaker" and the movable contact arm linkage 49, also described in the aforementioned U.S. patent application Ser. No. 08/863,649. The contact arm linkage 49 connects with the circuit breaker contact arms 15 (FIG. 1) by means of the contact arm connector 50 and with the trip indicator drive lever 28 by means of the connector rod 51 to set the position of the target plate 52 relative to the circuit breaker contacts 16, 17 (FIG. 1).

In accordance with the invention, the bell alarm unit 20, attached to the operating mechanism enclosure 13 by means of the bell alarm unit support plate 23, interacts with the trip indicator drive lever 28 by capture of the drive pin 26, extending from the driver slide 38 (FIG. 3), within the slot 27 formed within the trip indicator drive lever. The bell alarm plug-in module 32 having a pop-up target 33 extending from the top and a lock-out plunger 34 extending from the bottom is positioned on the support plate 23 by insertion of the lock-out plunger 34 within the plunger thru-hole 36 and aligning the pop-up target 33 under the indicator aperture 37 in the circuit breaker cover 12.

Figure 3:
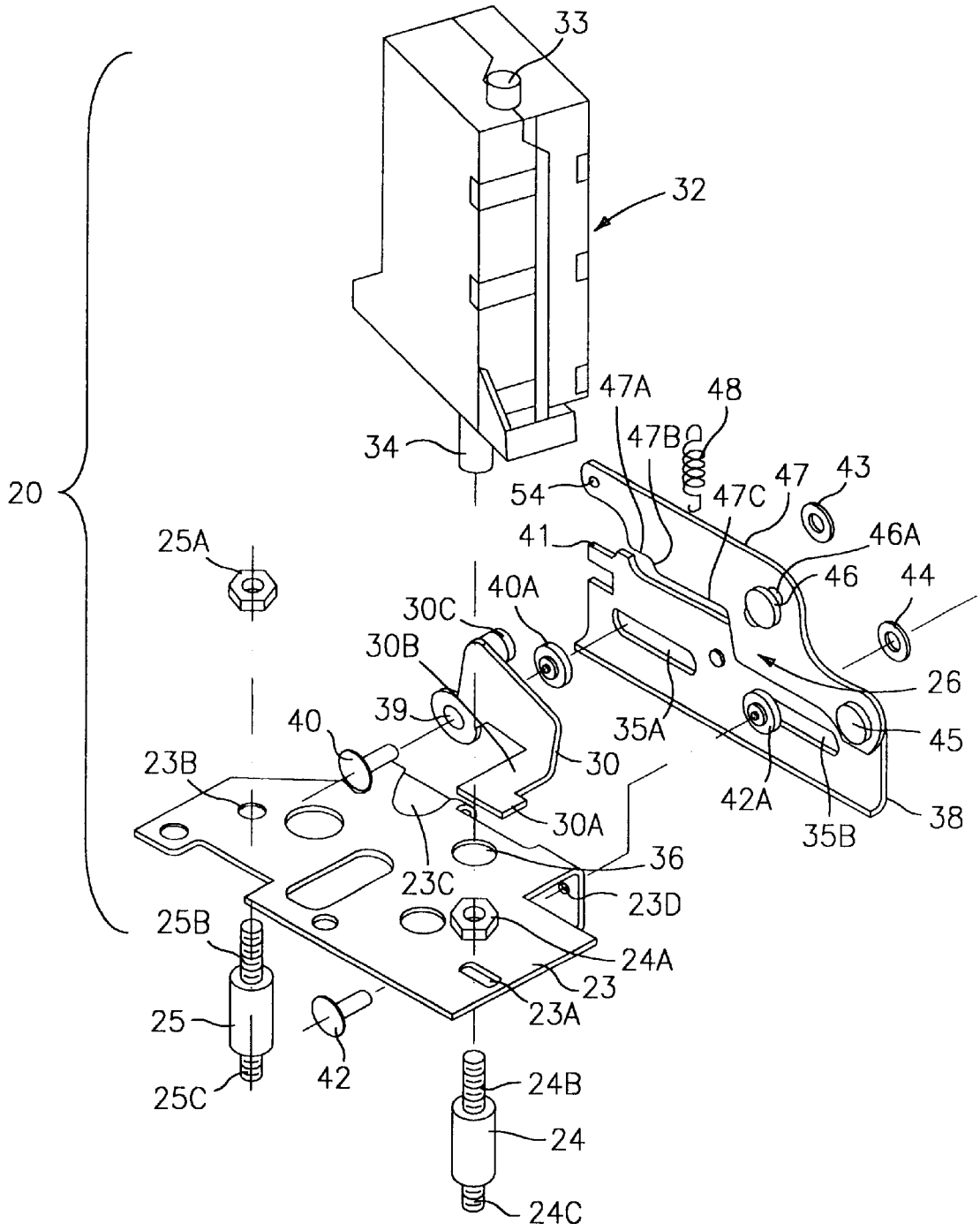
FIG. 3 is an exploded top perspective view of the components contained within the bell alarm unit of FIG. 2, in isometric projection.

The positioning of the components within the bell alarm unit 20 is best seen by now referring to FIG. 3 wherein the bell alarm support plate 23 is connected with a pair of stand-offs 24, 25 by insertion of the threaded ends 24B, 25B within the apertures 23A, 23B and securing same by means of nuts 24A, 25A. Connection with the operating mechanism enclosure 13 of FIG. 1 is made by the opposite threaded ends 24C, 25C threaded into tapped holes in enclosure 13. The actuator arm 30 is attached to the support plate 23 by means of a first pin 40, thru-hole 23C, thru-hole 39, spacer 40A and first elongated slot 35A within the driver slide 38. The reset tab 30A formed on the end of the angled extension 30B formed on the bottom of the actuator arm 30 is positioned under the plunger thru-hole 36 in the bell alarm support plate 23, and the reset pin 30C extending from the top of the actuator arm 30 is positioned between the bottom of the reset drive link 47 and the top of the driver slide 38 and interacts with the cam surfaces 47A–47C on the bottom of the reset drive link in the manner to be described below with reference also to FIGS. 4–7. The second pin 42 is inserted within the thru-hole 23D, spacer 42A and second elongated slot 35B to complete the attachment between the support plate 23, actuator arm 30 and driver slide 38. The ends of both pins 40 and 42 are riveted over washers 43 and 44. The end of the reset drive link 47 is pivotally attached to the end of the driver slide 38 by means of the third pin 45 and the central part of the reset drive link 47 is attached to the central part of the driver slide 38 by means of the fourth pin 46 and elongated slot 46A to allow the rotation of the reset drive link 47 relative to the driver slide 38 about pin 45. The end of the reset drive link 47 opposite the third pin 45 terminates in a thru-hole 54 which retains one end of a reset spring 48 and the opposite end of the reset spring is retained against the driver slide 38 by means of a tab 41. The drive pin 26, also shown earlier in FIG. 2 extends from the driver slide 38 in the direction opposite from the actuator arm 30. With the components of the bell alarm unit 20 completely assembled, the bell alarm plug-in module 32 is next positioned on the support plate 23 by insertion of the lock-out plunger 34 extending from the bottom thereof within the plunger thru-hole 36 formed in the support plate 23 such that the pop-up target 33 extending from the top passes through the indicator aperture 37 in the circuit breaker cover 12 as described earlier with reference to FIG. 1.

Figure 4:
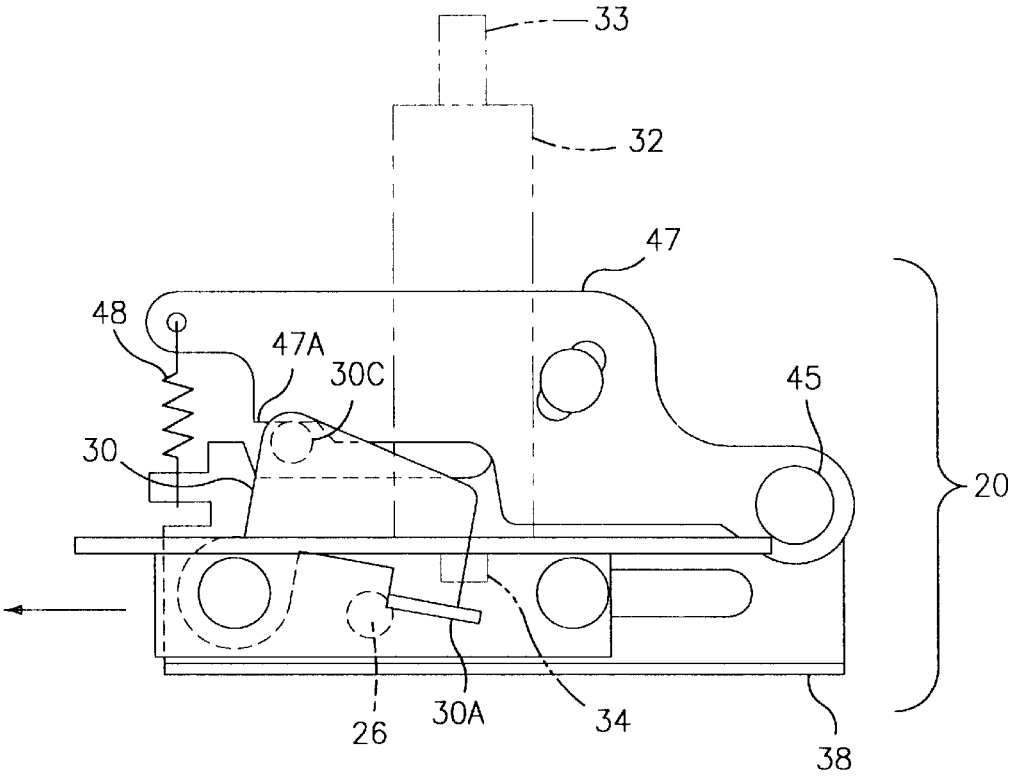
FIG. 4 is an enlarged side view of the bell alarm unit of FIG. 2 with the circuit breaker contacts in the OPEN condition.

The bell alarm unit 20 is depicted in FIG. 4 with the circuit breaker contacts 16, 17 of FIG. 1 in the OPEN condition such that the pop-up target 33 on the bell alarm plug-in module 32, as indicated in phantom, is extended from the top and the lock-out plunger 34 is extended from the bottom thereof. In this position, the reset pin 30C extending from the actuator arm 30 sits under cam surface 47A on the reset drive link 47 and is held in this position by the bias force exerted by the reset spring 48 in the counter-clockwise direction about the third or pivot pin 45.

Figure 5:
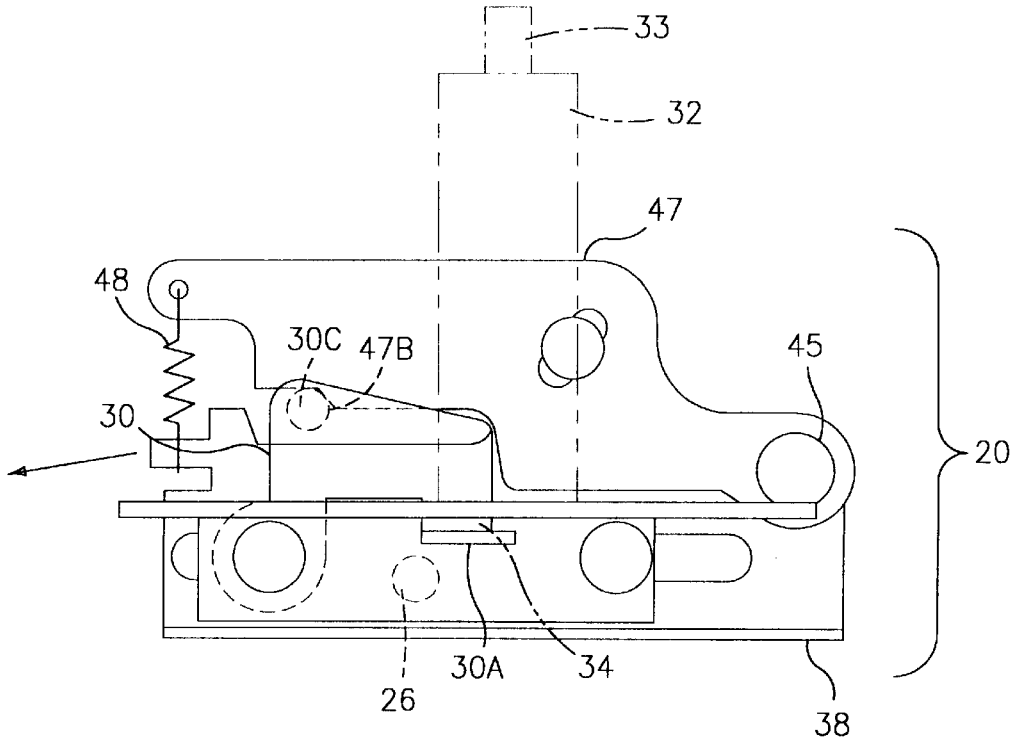
FIG. 5 is an enlarged side view of the bell alarm unit of FIG. 2 prior to moving the circuit breaker contacts to the CLOSED condition.

When the circuit breaker contacts move to the CLOSED condition as shown in FIG. 5, in the manner described in aforementioned U.S. patent application Ser. No. 08/863,649, the driver slide 38 moves in the indicated direction under the urgence of the drive pin 26 forcing cam surface 47B against reset pin 30C, thereby rotating the reset tab 30A against the lock-out plunger 34, on the bottom of the bell alarm plug-in module 32, and moving the lock-out plunger to the position now indicated in FIG. 5 such that the pop-up target 33 moves to the retracted position within the indicator aperture 37 of FIG. 2. When lock-out plunger 34 is completely reset, it blocks any further rotation of actuator arm 30. At this point, further movement of driver slide 38 in the close direction forces surface 47B to cam over the top of reset pin 30C against the bias exerted by the reset spring 48.

Figure 6:
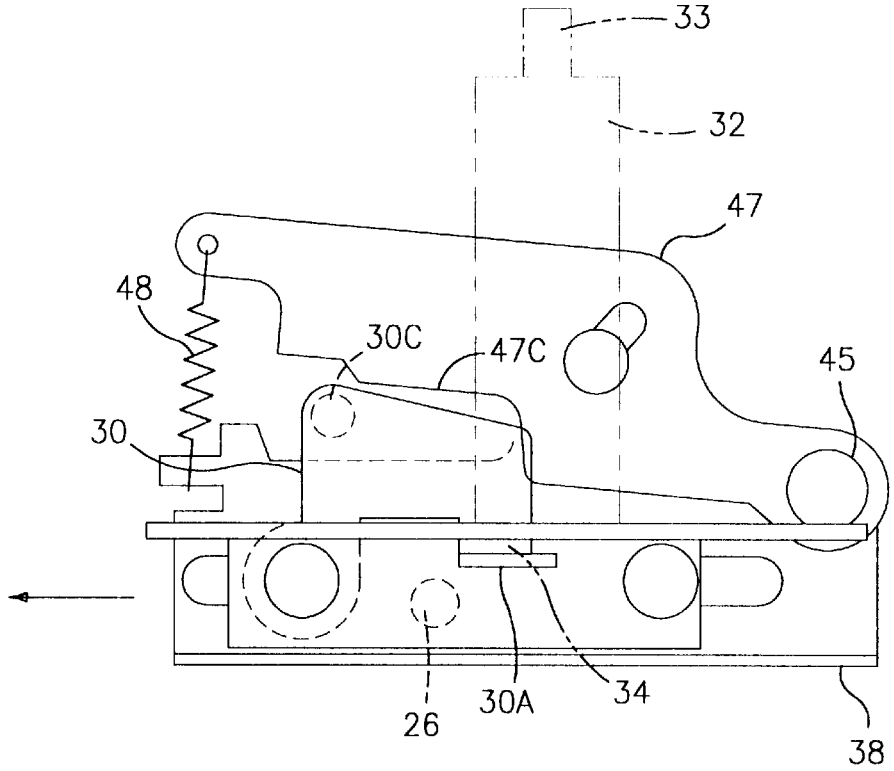
FIGS. 6 and 7 are enlarged side views of the bell alarm unit of FIG. 2 during and after moving the circuit breaker contacts to the CLOSED condition.
Figure 7:
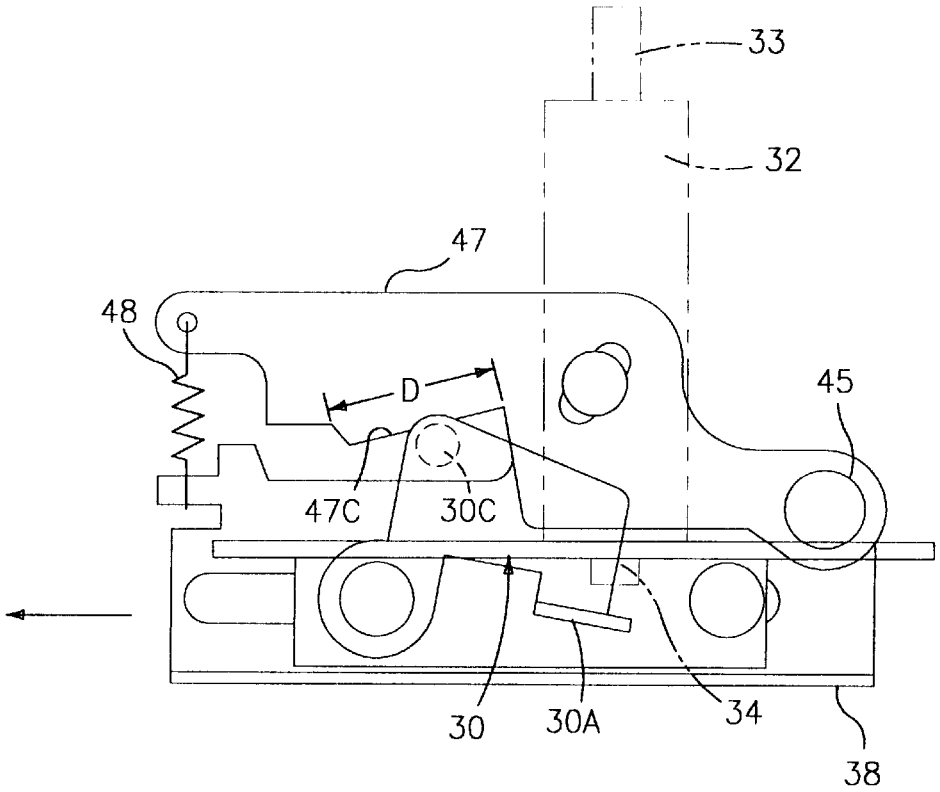

Continued movement in the indicated direction by driver slide 38 to the positions shown in FIGS. 6 and 7. The reset pin 30C on actuator arm 30 moves along the reset drive link 47 and becomes positioned now under cam surface 47C thereby allowing the reset tab 30A on the actuator arm 30 to move away from the lock-out plunger 34 on the bottom of the bell alarm plug-in module 32 from the position shown in FIG. 6 to that shown in FIG. 7 as the reset spring 48 moves from the extended position shown in FIG. 6 to the relaxed position shown in FIG. 7 as the circuit breaker contacts 16, 17 of FIG. 1 have become completely moved to the CLOSED condition. The extent of the distance D provided by cam surface 47C allows for tolerance in the time that the contacts become completely closed, independent of the accumulation of differences between the configuration of the contacts and the closing forces seen by the contacts used within the individual poles of a single circuit breaker as well as the differences occurring between various circuit breakers during the manufacturing process to insure, at all times, that the bell alarm plug-in module 32 is reset before the circuit breaker contacts have moved to the CLOSED position.

A bell alarm unit has herein been described that is factory or field installed on the top of the operating mechanism enclosure within an industrial air circuit breaker to insure that the bell alarm accessory is reset prior to closing the circuit breaker contacts. This assures that the ON/OFF conditions of the circuit breaker contacts are immediately ascertainable upon contact closure.

We claim:

1. A bell alarm unit comprising:

an apertured support platform arranged adjacent a circuit breaker bell alarm accessory;

an angled actuator arm pivotally attached to said support platform, said actuator arm having a side member extending in a first plane and a bottom member extending in a second plane perpendicular to said first plane;

a slotted driver slide slidably mounted to said support platform, said driver slide having a drive pin extending from one side, said drive pin arranged for interaction with a circuit breaker indicator assembly; and a reset drive link, said reset drive link pivotally attached to said driver slide at one end and attached to an opposite end of said driver slide by a bias spring, whereby the circuit breaker bell alarm accessory becomes reset prior to closing of circuit breaker contacts contained therein.

2. The bell alarm unit of claim 1 wherein a lock-out plunger on a bottom of the circuit breaker bell alarm accessory extends through an aperture in said support platform for interaction with said actuator arm bottom member.

3. The bell alarm unit of claim 1 wherein said slotted driver slide includes a first and a second elongated slot and said support platform includes a first and a second spacer pin, said first spacer pin being arranged within said first slot and said second spacer pin being arranged within said second slot.

4. The bell alarm unit of claim 1 wherein said reset drive link defines a plurality of cam surfaces formed thereon, and said actuator arm side member includes a reset pin extending therefrom, said reset pin being trapped between said reset drive link cam surfaces and a top part of said slotted driver slide.

5. The bell alarm unit of claim 1 wherein a pop-up target on a top part of the bell alarm accessory extends when a lock-out plunger on a bottom of a bell alarm accessory contacts said actuator arm bottom member for retraction of said pop-up target.

6. The bell alarm unit of claim 1 wherein said support platform is adapted for attaching to a circuit breaker operating mechanism enclosure.

7. The bell alarm unit of claim 1 wherein said support platform is attached to a circuit breaker operating mechanism enclosure by stand-off connectors.

8. The bell alarm unit of claim 4 wherein said reset pin moves along said cam surfaces in cam-follower relation.

9. A circuit breaker comprising:

a pair of contacts arranged at a first end of a contact arm;

a circuit breaker operating mechanism cross bar for moving said contacts between closed and open conditions;

a circuit breaker cover arranged over an operating mechanism enclosure;

a circuit breaker bell alarm accessory; and a bell alarm unit arranged on a top part of said operating mechanism enclosure for indicating when said contacts are in said closed and open conditions; said bell alarm unit comprising:

an apertured support platform arranged adjacent said circuit breaker bell alarm accessory unit;

an angled actuator arm pivotally attached to said support platform, said actuator arm having a side member extending in a first plane and a bottom member extending in a second plane perpendicular to said plane;

a slotted driver slidably mounted to said support platform, said driver slide having a drive pin extending from one side, said drive pin arranged for interaction with a circuit breaker indicator assembly; and a reset drive link, said reset drive link pivotally attached to said driver slide at one end and attached to an opposite end of said driver slide by a bias spring, whereby a circuit breaker bell alarm accessory becomes reset prior to closing of said circuit breaker contacts.

10. The circuit breaker of claim 9 including a lock-out plunger on a bottom of the circuit breaker bell alarm accessory extends through an aperture in said support platform for interaction with said actuator arm bottom member.

11. The circuit breaker of claim 9 wherein said slotted driver slide includes a first and a second elongated slot and said support platform includes a first and a second spacer pin, said first spacer pin being arranged within said first slot and said second spacer pin being arranged within said second slot.

12. The circuit breaker of claim 9 wherein said reset drive link defines a plurality of cam surfaces formed thereon, and said actuator arm side member includes a reset pin extending therefrom, said reset pin being trapped between said reset drive link cam surfaces and a top part of said slotted driver slide.

13. The circuit breaker of claim 9 wherein a pop-up target on a top part of the bell alarm accessory extends when a lock-out plunger on a bottom of a bell alarm accessory contacts said actuator arm bottom member for retraction of said pop-up target.

14. The circuit breaker of claim 9 further wherein said support platform is adapted for attaching to said circuit breaker operating mechanism enclosure.

15. The circuit breaker of claim 9 wherein said support platform is attached to said circuit breaker operating mechanism enclosure by stand-off connectors.

16. The circuit breaker of claim 12 wherein said reset pin moves along said cam surfaces in cam-follower relation.

* * * * *